US005139820A

United States Patent [19]

Sawada et al.

[11] Patent Number: 5,139,820

[45] Date of Patent: Aug. 18, 1992

[54] METHOD OF MANUFACTURING CERAMIC INSULATED WIRE

[75] Inventors: Kazuo Sawada; Shinji Inazawa; Kouichi Yamada, all of Osaka, Japan

[73] Assignee: Sumitomo Electric Industries, Ltd., Osaka, Japan

[21] Appl. No.: 632,158

[22] Filed: Dec. 21, 1990

[30] Foreign Application Priority Data

Dec. 28, 1989 [JP] Japan ..... 1-341393

[51] Int. Cl.[5] ..... B05D 5/12

[52] U.S. Cl. ..... 427/120; 427/126.2; 427/126.3; 427/376.2; 427/419.2; 252/315.2; 174/110 A

[58] Field of Search ..... 427/117, 118, 120, 126.2, 427/126.3, 126.4, 376.2, 419.2; 501/12; 252/315.2, 315.01.315.1; 264/174; 428/375; 174/110 A, 110 R, 110 SR, 110 S; 156/DIG. 108

[56] References Cited

U.S. PATENT DOCUMENTS 4,921,731 5/1990 Clark et al. ..... 427/376.3
5,028,489 7/1991 Kissel ..... 428/469

FOREIGN PATENT DOCUMENTS 63-195283 8/1988 Japan .
63-281313 11/1988 Japan ..... 427/120
1-52338 2/1989 Japan .
1-192006 8/1989 Japan .
2185011 7/1987 United Kingdom ..... 252/315.01

OTHER PUBLICATIONS

Nelson, R. L. et al., "The Coating of Metals with Ceramic Oxides Via Colloidal Intermediates", Thin Solid Films, vol. 81, No. 4 (Jul. 31, 1981), pp. 329–337.

*Primary Examiner*—Shrive Beck
*Assistant Examiner*—Terry J. Owens
*Attorney, Agent, or Firm*—W. G. Fasse; D. H. Kane, Jr.

[57] ABSTRACT

A method of manufacturing a ceramic insulated wire involves preparing an extrudable gel compound formed by dissolving a metal-organic compound in a solvent and adding at least one thermoplastic polymer or its monomer to the mixture to make the gel compound extrudable. The so prepared extrudable gel compound is then extruded around the outer periphery of a conductor for coating the conductor with a gel coating. Thereafter a heat treatment is performed for sintering the gel compound to form a ceramic coating.

9 Claims, 1 Drawing Sheet

METHOD OF MANUFACTURING CERAMIC INSULATED WIRE

BACKGROUND OF THE INVENTION

1. Field of the Invention

The present invention relates to a method of manufacturing a ceramic insulated wire, which can be used for heat resistant and fire resistant wires, a radiation resistant nuclear wire, a wire for a vacuum apparatus, and the like.

2. Background Information

An MI cable, a glass braided tube insulated wire, an insulated wire in a ceramics tube and the like are known as conventional insulated wires. Such conventional insulated wires are disadvantageous for use where the available space is limited. Further, the configurations of conventional insulated wires of this type are restricted to wires with a round cross-section.

Also known is an insulated wire manufactured by the so-called wet process, such as Nippon Sheet Glass method (LPD method) or a sol-gel method of applying a ceramic precursor solution which is prepared by hydrolyzing metal alkoxide or the like.

However, it is industrially difficult to obtain a thick film by such a wet process. In other words, the thickness of a film formed by a single application/baking operation is extremely small, and the application/baking step must be repeated many times in order to attain a sufficient film thickness.

SUMMARY OF THE INVENTION

It is an object of the present invention to provide a method of efficiently manufacturing a mineral insulated wire by a wet process, which can be easily industrially applied to a thick film.

The present manufacturing method comprises a step of preparing a gel compound formed by dissolving an organic compound of a metal in a solvent and adding at least one thermoplastic polymer or its monomer, and a step of extruding the gel compound around the outer periphery of a conductor for coating the conductor and thereafter performing a heat treatment for sintering the gel compound.

The organic compound of a metal employed in the present invention is prepared from metal alkoxide, metal organic acid salt, or the like. The metal alkoxide, which is adapted to form $SiO_2$, $Al_2O_3$, $ZrO_2$, $TiO_2$, MgO or the like, is composed of ethoxide, propoxide, butoxide or the like. The organic acid salt is preferably prepared of metallic salt such as naphthenic salt, caprylic salt, stearic salt, octylic salt or the like.

The term "gel compound" used in this specification indicates a precursor state compound, which is mainly formed by a sol-gel method or an organic acid salt thermal decomposition method and converted to ceramics a heat treatment.

A sol solution formed by the sol-gel method, for example, contains a ceramic precursor which is a metal-organic polymer compound or polymer of a metal having an alkoxide, a hydroxyl group and metalloxane bonds formed by a hydrolytic reaction and dehydration/condensation reaction of a compound having a hydrolyzable organic group such as a metal alkoxide, an organic solvent such as alcohol a metal alkoxide of the raw material, and small amounts of water and a catalyst required for hydrolytic reaction. The metalloxane bonds grow as the condensation reaction progresses and as the solvent volatilizes whereby the sol solution is converted from a liquid state to an agar-type gel state. In this gel state, organic substances, water and the like are held in a network structure having voids defined by the metalloxane bonds, providing such an excellent flexible state that a three-dimensional structure is not completed. However, conversion into the gel state is prompted by heating, although no such heating actually required. This gel enters a state hardly containing the organic substances, water and the like in the voids of the network structure upon heating or the like, and is converted to the so-called xerogel. The xerogel is further heated for condensation of the hydroxyl group and growth of the metalloxane bonds, to be finally converted to a metal oxide.

The metal organic compound employed in the present invention can be prepared of an organic compound of at least one metal selected from a group of Si, Al, Zr, Ti and Mg.

The thermoplastic polymer which is added to the solution of the metal organic compound is prepared of polyacrylic acid, for example, while the monomer is prepared of methacrylic acid, diethylene triamine or the like.

According to the present invention, the gel compound can contain ceramic powder, which can be prepared of whiskers, mica or the like, for example.

The gel compound is preferably heated when the same is extruded around the outer periphery of a conductor.

According to the present invention, further, it is preferable to cause a dehydration/condensation reaction and a polycondensation reaction to cause gelation by adding water and an acid catalyst, in order to form the gel compound.

The ceramics precursor prepared from metal alkoxide or the like is dehydrated/condensed by heating or the like, to be converted to a gel state. The gel-state ceramics precursor is increased in viscosity and brought into an extrudable jelly state. Such a gel compound is extruded to coat the outer periphery of the conductor. Thereafter the gel compound is heated for facilitating the reaction and further conversion into a ceramic.

Since such a gel compound is employed in the present invention, it is possible to form a thick coating layer around the conductor through a single step. Further, since the gel compound a high viscosity, ceramic particles or the like can be added and homogeneously mixed into the same with no problem of precipitation or the like. Thus, it is possible to reinforce the ceramic film and improve the insulating ability by homogeneously adding the ceramics particles etc. to the gel compound.

When the metal organic compound contained in the gel compound employed in the present invention is prepared of an organic compound of a metal such as Si, Al, Zr, Ti or Mg, it is possible to obtain a ceramic insulating film having an excellent insulating ability.

The thermoplastic polymer which is added to the gel compound can be made of silicone resin. When silicone resin is thus employed, it may be possible to improve the flexibility of the gel compound and to improve the adhesion of the gel compound to the conductor when the same is converted to ceramics. In this case, the content of silicone resin is preferably 15 to 70 parts. The effect attained by the addition of silicone resin is reduced if the content thereof is less than 10 parts, while it is difficult to completely convert the gel compound to ceramic if the content exceeds 70 parts.

The conductor is preferably made of Ni or Cu which is coated with stainless steel, in order to improve the oxidation resistance.

Alternatively, the conductor is preferably made of Al having an oxide film of Al, in order to improve the adhesion with the film which has been converted to a ceramic.

According to the present method, as hereinabove described, it is possible to easily and industrially form a thick ceramic insulating layer.

In the method according to the present invention, the ceramics precursor is converted to a ceramic to obtain the mineral insulating layer, whereby a heat treatment can be performed at a lower temperature as compared with a melt coating method and the deterioration of conductor characteristics can be prevented during manufacturing. The heat treatment equipment can be simplified.

These and other objects, features, aspects and advantages of the present invention will become more apparent from the following detailed description of the present invention when taken in conjunction with the accompanying drawing.

DESCRIPTION OF THE PREFERRED EMBODIMENTS

Example 1

Figure 1:
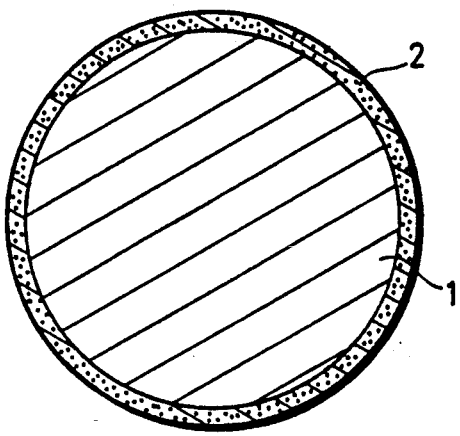
FIG. 1 is a sectional view through a conductor wire coated with a gel compound according to the present invention.

A solution prepared by diluting 15 mM of tetraethyl orthosilicate with 50 mM of ethanol was added as alkoxide of silicone to a solution prepared by diluting 40 mM of diethylene triamine with 600 mM of water and mixed at room temperature. Then the mixture was stirred at room temperature for several minutes to start whitening and gelling in about 10 minutes. This gel was aged at a constant temperature of 30° C. for about eight hours, to obtain a gel compound. Then, a nickel-plated copper wire of 1 mm in wire diameter was vapor-degreased with triperchloroethylene. Thereafter the gel compound 2 was applied onto the nickel-plated copper wire 1 by an extrusion process to provide a coating thickness of 30 μm, as shown in FIG. 1. As to the extrusion, an outlet temperature (crosshead temperature) of 60° C. was employed and a heat treatment was continuously performed at 150° C. immediately after the application step.

A sample of 30 cm in length was obtained from the coated insulated wire. Platinum foil members of 0.02 mm in thickness were closely wound on wire portions of about 10 mm in length, which were spaced apart at intervals of about 50 mm from each other. An alternating voltage of 60 Hz was applied across the conductor and the platinum foil members, whereby a dielectric breakdown was caused at 2.5 kV.

A sample of 30 cm in length of the above insulated wire also provided with platinum foil members as described above was heated at 500° C. for 30 minutes. An alternating voltage of 60 Hz was applied to the heated sample across the conductor and the platinum foil members, whereby a breakdown was caused at 1.2 kV.

A heating cycle of holding the insulated wire in an atmosphere with a degree of vacuum of $1\times10^{-4}$ Torr at a temperature of 700° C. for 10 minutes and then cooling the same to room temperature was repeated ten times, to make a breakdown test. A breakdown voltage of 1.2 kV was maintained.

Then, a coil was prepared by winding the insulated wire on a cylinder of 100 mm in diameter and then extracting the cylinder. As the result of a breakdown test, the coiled insulated wire maintained a breakdown voltage of 1.2 kV.

EXAMPLE 2

100 mM of methacrylic acid, 5 mM of magnesium isopropoxide and 25 mM of aluminum isobutoxide were dissolved in a mixed solvent of 50 mM of MEK, 10 mM of acetone and 100 mM of p-xylene and mixed at the room temperature, and then 5 g of silicone resin was further mixed into the mixture. This mixture was concentrated at 110° C., to obtain a gel compound.

Then, a nickel-plated copper wire having a diameter of 1 mm was vapor-degreased with triperchloroethylene. Thereafter the above gel compound 2 was applied onto the nickel-plated copper wire 1 by extrusion at a thickness of 30 μm, as shown in FIG. 1. As to the extrusion, an outlet temperature (crosshead temperature) of 120° C. was employed and a heat treatment was continuously performed at 150° C. immediately after the extrusion application step.

A sample of 30 cm in length was obtained from the coated insulated wire. Platinum foil members of 0.02 mm in thickness were closely wound on four wire portions of about 10 mm in length, which were spaced apart at intervals of about 50 mm from each other. An alternating voltage of 60 Hz was applied across the conductor and the platinum foil members, whereby a breakdown was caused at 2.6 kV.

The insulated wire prepared as just described was heated at 500° C. for 30 minutes. An alternating voltage of 60 Hz was applied across the conductor and the platinum foil members, whereby a breakdown was caused at 1.8 kV.

A heating cycle of holding the insulated wire in an atmosphere with a degree of vacuum of $1\times10^{-4}$ Torr at a temperature of 700° C. for 10 minutes and then cooling the same to room temperature was repeated ten times, to make a breakdown test. The above breakdown voltage of 1.8 kV was maintained.

Then, a coil was prepared by winding the insulated wire on a cylinder of 100 mm in diameter and then extracting the cylinder. The coiled insulated wire maintained a breakdown voltage of 1.8 kV, as the result of a breakdown test performed as described above.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of manufacturing a ceramic insulated wire, comprising the steps of:

(a) preparing a gel compound formed by dissolving an organic compound of a metal in a solvent;

(b) increasing the viscosity of said gel compound to make said gel compound extrudable by adding to said gel compound at least one member of the group consisting of thermoplastic polymers and thermoplastic monomers of said thermoplastic polymers;

(c) extruding said gel compound around the outer periphery of a conductor for coating said conductor with a gel coating; and (d) heat treating said conductor and gel coating for sintering said gel compound to form a ceramic insulation on said conductor.

2. The method of claim 1, wherein said organic compound of a metal is an organic compound of at least one metal selected from the group consisting of Si, Al, Zr, Ti and Mg.

3. The method of claim 1, wherein one of methacrylic acid and diethylene triamine is employed as said monomer of said thermoplastic polymer, and wherein polyacrylic acid is employed as said thermoplastic polymer.

4. The method of claim 1, wherein said gel compound contains at least one ceramic powder.

5. The method of claim 4, wherein said ceramic powder comprises at least one of whiskers and mica.

6. The method of claim 1, wherein said gel compound is heated during extrusion around the outer periphery of said conductor.

7. The method of claim 1, wherein said thermoplastic polymer contains silicone resin.

8. The method of claim 1, wherein a dehydration/-condensation reaction and a polycondensation reaction are caused by adding water and an acid catalyst in step (a) for gelation for forming said extrudable gel compound.

9. The method of claim 1, wherein said extruding step forms on said conductor a gel coating having a thickness of at least 30 μm.

* * * * *